US006230996B1

(12) United States Patent
Angers, Jr.

(10) Patent No.: US 6,230,996 B1
(45) **Date of Patent: *May 15, 2001**

(54) PULVERIZER/GRINDER SYSTEM

(76) Inventor: John W. Angers, Jr., 488 Apricot St., New Iberia, LA (US) 70560

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,614

(22) Filed: Mar. 24, 1999

(51) Int. Cl.[7] ..... B02C 13/28

(52) U.S. Cl. ..... 241/27; 241/73; 241/189.1; 241/195; 241/197

(58) Field of Search ..... 241/195, 197, 241/189.1, 73, 188.1, 30, 27

(56) References Cited

U.S. PATENT DOCUMENTS

| | | | | |
|---|---|---|---|---|
| 345,408 | | 7/1886 | Birge . | |
| 410,247 | | 9/1889 | Kimble . | |
| 500,582 | | 7/1893 | Jones . | |
| 666,404 | | 1/1901 | Wurster . | |
| 1,033,886 | | 9/1912 | Hirt . | |
| 1,457,693 | | 6/1923 | Dorn . | |
| 1,785,435 | * | 12/1930 | Bullock | 241/197 |
| 2,086,383 | * | 7/1937 | Gruender | 241/189.1 |
| 2,133,212 | * | 10/1938 | Schutte et al. | 241/197 |
| 2,558,255 | * | 6/1951 | Johnson et al. | 241/189.1 |
| 2,991,947 | | 7/1961 | Schuvler . | |
| 3,608,838 | * | 9/1971 | Lundin et al. | 241/188.1 |
| 3,957,210 | | 5/1976 | Durr . | |
| 3,993,254 | | 11/1976 | Bicik et al. . | |
| 4,222,988 | | 9/1980 | Barthel . | |
| 4,480,702 | | 11/1984 | Kelly, Jr. . | |
| 4,544,032 | | 10/1985 | Echols . | |
| 5,294,061 | | 3/1994 | van Dijk . | |
| 5,303,786 | | 4/1994 | Prestridge et al. . | |
| 5,400,977 | | 3/1995 | Hayles, Jr. . | |
| 5,405,223 | | 4/1995 | Sirevag . | |
| 5,490,636 | * | 2/1996 | Schrodl | 241/189.1 |

* cited by examiner

*Primary Examiner*—Mark Rosenbaum
(74) *Attorney, Agent, or Firm*—Joseph T. Regard, Ltd plc

(57) ABSTRACT

A pulverizer/grinder configured, its principle embodiment, to process drilling mud having cuttings utilizing a shaft on a horizontal axis having multiple rotors emanating therefrom. The rotors are surrounded by a cylindrical housing having inner walls situated near the tips of the rotors, each rotor further including first and second pulverizing members. The upper portion of housing includes input ports for the ingress of cuttings, drilling mud, and fluid, the lower portion of the housing including a cuttings screen having the desired aperture size for the egress of appropriately ground cuttings, particles, and fluid. Included with the system is a specially designed lug which emanates from the inner surface of the upper housing unit, the lug configured to securely communicate with the upper edge of the cuttings screen, securely holding same in place and preventing the buildup of debris thereabouts. The shaft utilizes a unique seal cartridge for lubrication between the pulverizer/grinder housing and pillow block bearings. A unique rotor blade configuration optimizes grinding efficiency, providing a carbide, angled rectilinear design. The pulverizer/grinder of the present system is designed to be directly fed from a hopper in conjunction with a shell shaker, with the pulverizer/grinder mounted upon a slurry tank for receiving the processed cuttings and fluid. Alternately, the pulverizer/grinder of the present system may be utilized, wet or dry, to pulverize aggregate and other materials in other, non-oil field contexts.

13 Claims, 8 Drawing Sheets

PULVERIZER/GRINDER SYSTEM

TECHNICAL FIELD OF THE INVENTION

The present invention relates to drill cuttings remediation systems, and in particular to a pulverizer/grinder, in its principle embodiment, configured to process drilling mud having cuttings therein. The preferred embodiment of the invention teaches a unit having a shaft on a horizontal axis having multiple rotors emanating therefrom, the system surrounded by a cylindrical housing having inner walls situated near the tips of the rotors, each rotor further including first and second, side mounted pulverizing members, the inner wall of the housing, in conjunction with the rotors and the first tips of the mounted pulverizing members, forming the grinding/pulverizing surface.

The upper portion of housing includes input means for the ingress of cuttings, drilling mud, and fluid, the lower portion of the housing further including output means in the form of a cuttings screen having the desired aperture size for the egress of appropriately ground cuttings, particles, and fluid. Included with the system is a specially designed lug which emanates from the inner surface of the upper housing unit, the lug configured to securely communicate with the upper edge of the cuttings screen, securely holding same in place and preventing the buildup of debris thereabouts.

The shaft of the pulverizer/grinder unit is powered by an exterior motor via a coupling, the shaft utilizing a unique seal cartridge for lubrication between the pulverizer housing and pillow block bearings. Further complimenting the design is a unique cuttings blade configuration which optimizes grinding efficiency, providing a carbide, angled, rectilinear design having pulverizing members mounted thereupon.

The present design of the system provides a particularly effective pulverizer/grinder, while requiring little operational supervision, effectively preventing build up of debris within the unit; hence, a self-cleaning system.

The grinder of the present system is designed to be directly fed from a hopper in conjunction with a shell shaker, with the pulverizer/grinder mounted upon a slurry tank for receiving the processed cuttings and fluid. A fluid line from the slurry tank containing the processed grindings and fluid may be re-injected into the well via injection system; a second, recirculation line may run from the slurry tank to the pulverizer/grinder be utilized to provide fluid flow for efficient processing grindings, the rate of recirculation depending upon the operating environment.

In addition to processing drill cuttings, the present system is also particularly suitable for pulverizing other non-metal material in a wet or dry context, including, for example, aggregate for on-site road bed formation.

BACKGROUND OF THE INVENTION

Cuttings remediation is not a new concept in and of itself, various attempts at processing and reinjecting ground cuttings having been tried over the years, yet remediation has only relatively recently been considered a requisite in petroleum exploration, with recognition of the adverse environmental impact of dumped drill cuttings and drilling mud upon environment.

There are two options for disposal other than dumping, which is not environmentally sound and may be illegal in some jurisdictions, namely 1) dumping of the cuttings at a landfill, or 2) reinjection of the cuttings into the well. While drill cuttings are disposed of at designated low hazardous waste landfills, the costs of transportation and disposal are generally prohibitive, especially when the drilling occurs in remote areas.

There is, therefore, a more urgent need than ever for an efficient cuttings remediation system which reintroduces processed cuttings into the well.

A list of patents which may have some pertinence to the present invention include:

| U.S. Pat. No. | Inventor | Date of Issue |
|---|---|---|
| Grinders/pulverizers: | | |
| 5400977 | Hayles, Jr. | 03/28/1995 |
| 3993254 | Bicik et al | 11/23/1976 |
| 3957210 | Durr | 05/18/1976 |
| 2991947 | Schuyler | 07/11/1961 |
| 1038886 | Hirt | 09/17/1912 |
| 666404 | Wurster | 01/22/1901 |
| 500582 | Jones | 07/04/1893 |
| 410247 | Kimble | 09/03/1889 |
| 345408 | Birge | 07/13/1886 |
| Cuttings Processing: | | |
| 5405223 | Sirevag | 05/11/1995 |
| 5303786 | Prestridge et al | 04/19/1994 |
| 5294061 | Van Dijk | 03/15/1994 |
| 4544032 | Echols | 10/01/1985 |
| 4480702 | Keily, Jr. | 11/06/1984 |
| 4222988 | Barthel | 09/16/1980 |

U.S. Pat. No. 1,038,886 issued 1912 teaches a "pulverizer" including a shaft on a horizontal axis having multiple rotors emanating therefrom, the system further surrounded by a cylindrical housing having inner walls having "perforations" situated near the tips of the rotors, each tip further including a "beater".

U.S. Pat. No. 410,247 issued 1889 teaches an "apparatus for atomizing solid substances" including first and second, horizontally situated shafts having multiple, intermeshing rotors emanating therefrom. See also U.S. Pat. Nos. 500, 582, 345,408, 666,404 and 5,400,977.

U.S. Pat. No. 4,222,988 issued 1980 teaches an "apparatus for removing hydrocarbons from drill cuttings" including milling means in the form of a horizontal shaft (19) having a plurality of rotors emanating therefrom (17, 20), the ends of the rotors in close proximity to a cylindrical housing (FIG. 3). U.S. Pat. Nos. 4,480,702, 5,405,223, 4,544,032, 5,303,032, and 5,294,061 teach drill cuttings processing apparatus; see FIG. 2 of the '061 patent, which teaches a mill including a rotating shaft having rotors for milling the cuttings, enclosed within a cylindrical housing.

While the above cited prior art teachings teach rotor mills having some similarities when compared to the present invention, none teach the improvements disclosed, nor the operating configuration of the present system. It is averred that prior art drill cuttings remediation systems have traditionally been either expensive to implement, or ineffective in real world operations, requiring continual maintenance and operational supervision, as well as monitoring to prevent clogging or jamming of the unit.

GENERAL SUMMARY DISCUSSION OF THE INVENTION

The present invention contemplates a pulverizer/grinder system for processing drill cuttings for re-injection into the well, providing a pulverizer/grinder system which is relatively simple to operate and maintain, while being cost effective to manufacture and implement.

The pulverizer/grinder of the present system is configured to be used a main component in a drill cuttings remediation system, the pulverizer/grinder designed to be directly fed from the shell shaker, or, alternatively, via hopper to which the shell shaker feeds, with the pulverizer/grinder mounted upon a slurry tank for receiving the processed cuttings and fluid.

The pulverizer/grinder may be operated dry under some conditions, and may, under some conditions, actually perform better dry than with fluid circulation, although for most applications it is advantageous to have fluid present in the pulverizer/grinder, and for this reason a fluid line from the slurry tank is fed back into the pulverizer/grinder to provide fluid flow to aid in the flow of cuttings and particulates through the system.

The present exemplary embodiment of the invention, which has been implemented in the field, includes 18 sets of rotors situated three sets of six rotors equilaterally spaced fashion (thirty degrees), with cutting/grinding carbide or carbide overlaid pulverizing members affixed to the opposing sides of each rotor, the ends of which may also be overlaid with carbide. The exemplary system is rotated at a speed of about 1700–1800 RPM, which, along with the screen size of the pulverizer/grinder chamber may vary according to flow, cuttings properties, requirements, and other environmental criteria.

The housing design of the present system includes a unique means of securing the screen against the housing to prevent detachment of same, comprising a specially designed lug which emanates from the inner surface of the upper housing unit, the lug configured to securely communicate with the upper edge of the cuttings screen, the securement means preventing debris buildup at the securement area.

An exterior motor powers the pulverizer/grinder unit, the shaft utilizing a unique seal cartridge for lubrication between the pulverizer/grinder housing and pillow block bearings. Further complimenting the design is a unique cuttings blade configuration which optimizes grinding efficiency, providing a carbide, angled, rectilinear design, forming in conjunction with the other rotors a highly effective shattering array, which effectively and quickly reduces the size of non-metal material introduced into the system.

While the apparatus of the present invention is taught as being utilized in conjunction with oil field drill cuttings remediation, the pulverizer/grinder also has other diverse applications outside of the oil field including, for example, pulverizing gravel for forming roadbeds, and grinding aggregate and other material for diverse purposes.

It is therefore an object of the present invention to provide a drill cuttings remediation system which is economical in manufacture and maintain, while being effective in pulverizing a variety of materials.

It is another object of the present invention to provide a drill cuttings pulverizer/grinder which has the capability of running with or without fluid circulation, and which may run dry for extended periods of time in some applications.

It is another object of the present invention to provide a pulverizer/grinder which may be utilized to process diverse materials including drill cuttings, various aggregates and the like.

It is another object of the present invention to provide a drill cuttings remediation system which has a unique rotor blade configuration configured to provide pulverization of material with optimal efficiency.

Lastly, it is an object of the present invention to provide a method and system for pulverizing non-metal material which is self cleaning, requiring little in the way of monitoring and operational supervision.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
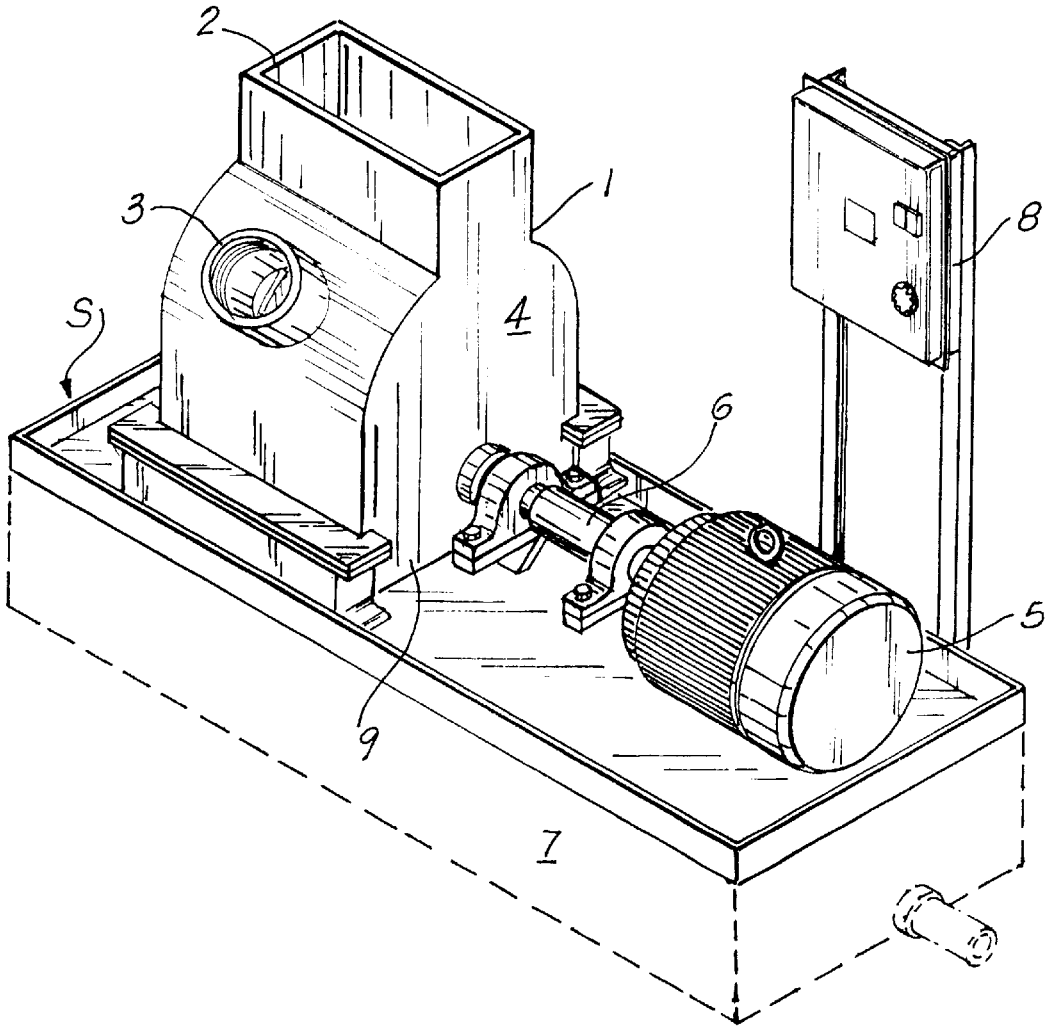
FIG. 1 is an isometric view of the preferred embodiment of the pulverizer/grinder of the present invention, illustrated installed atop a slurry tank in an oil field drillings cuttings remediation context.

Referring to FIG. 1, the system S of the present invention, configured for drill cuttings remediation, wherein the cuttings and other debris from the drilling processed is pulverized to a predetermined size and re-injected into the well, comprises a pulverizer/grinder unit 1 having first 2 and second 3 inputs, the first input primarily configured to receive cuttings and debris with or without fluid, the second input to receive fluid and particulates, although it is noted that the present unit may operate dry, without the necessity of fluid for circulation, under some circumstances, and the first 2 and second 3 may be used interchangeably, depending upon the application.

Continuing with the drawings, the pulverizer/grinder unit 1 includes a housing 4 having a shaft 6 passing therethrough, which shaft is powered by an exterior motor 5, in the exemplary embodiment, providing generally between 1750–1800 RPM, and may vary as much as 1000–2250

RPM, depending upon the application, equipment, operating environment, etc.

The pulverizer/grinder unit has an open bottom which communicates at its base 9 with a slurry tank, holding tank or the like 7 to receive the particulates and fluid from pulverizer/grinder 1. A control panel 8 controls the functions of the unit, and may include indicators for operational conditions, an hour meter, etc.

Figure 2:
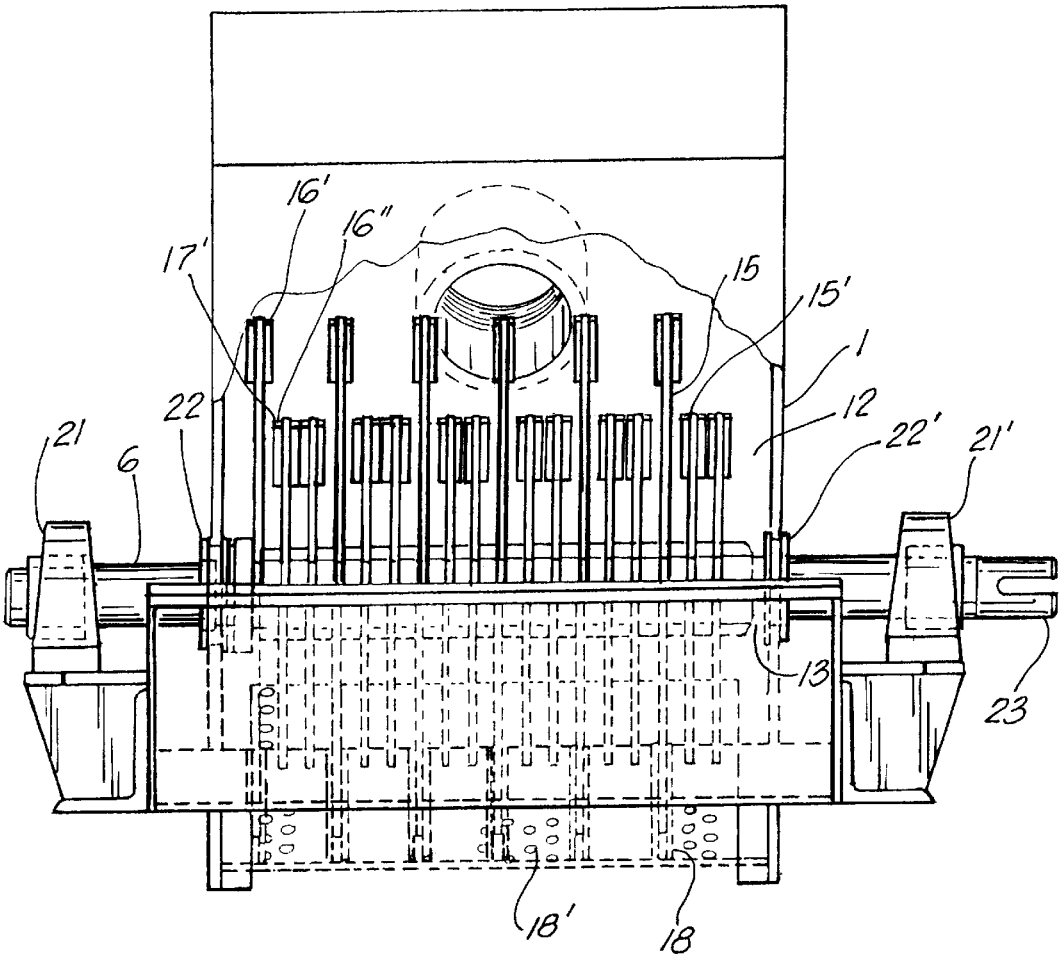
FIG. 2 is a side, partially cut-away view of the preferred grinder of the present invention, illustrating the rotor array mounted upon the horizontal shaft, as well as the location of the seal cartridges.
Figure 5:
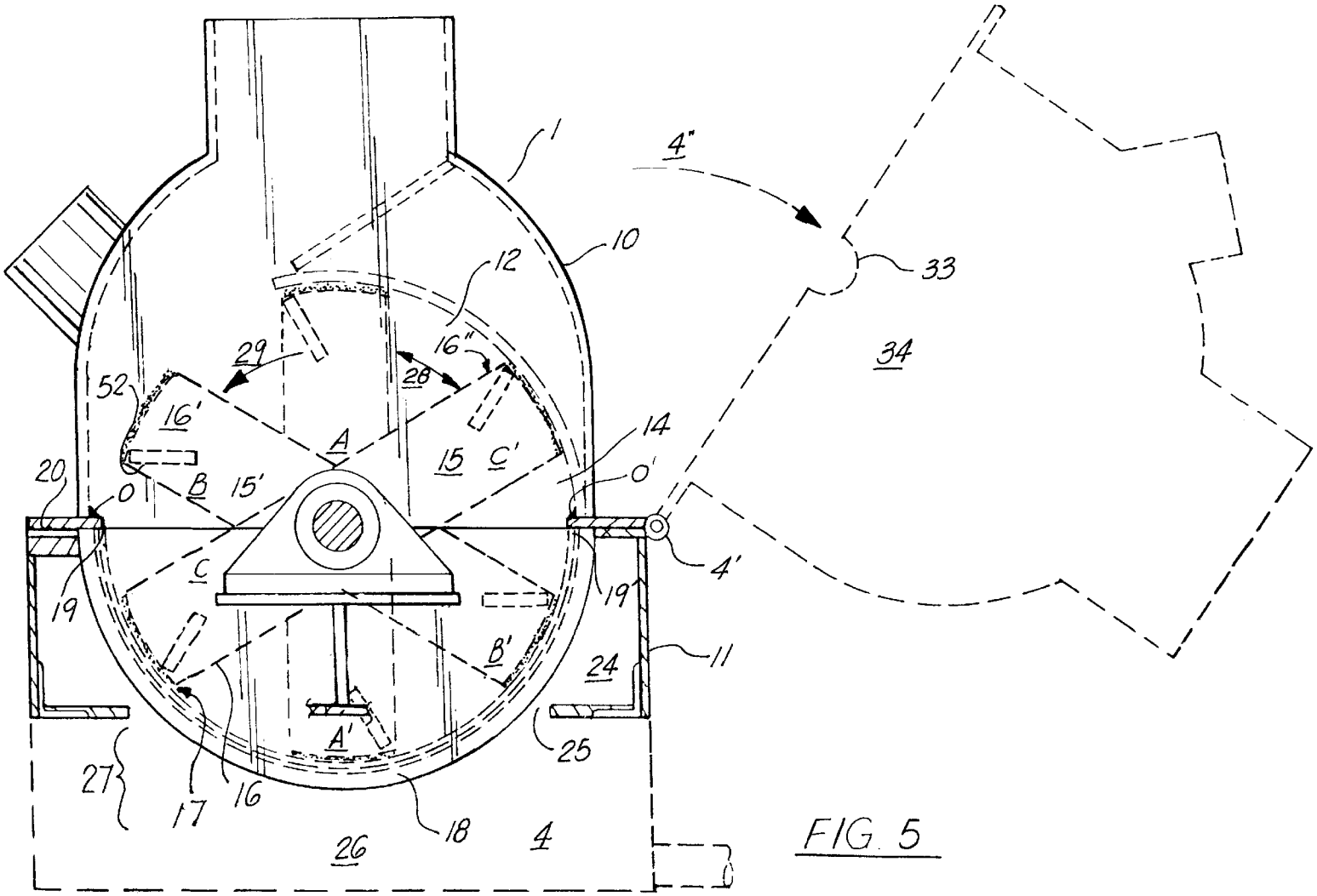
FIG. 5 is an end view of the pulverizer/grinder of the preferred embodiment of the present invention, illustrating the hinged housing having first and second upper, inflow sections, and a lower, screened, egress area, along with the rotors in phantom.

Continuing with FIGS. 2 and 5, the housing of the pulverizer/grinder unit 1 includes an upper portion 10 which is hingedly 4' connected to a lower portion 11 which allows the unit to be opened 4" for access, inspection, cleaning, maintenance, etc.

The housing lower portion 11 of the pulverizer/grinder 1 forms a box 24 having an open bottom 25 which allows passage of pulverized debris therethrough via the lower portion 27 of a screen 18, which pulverized debris is released into the inside 26 of the slurry tank.

As shown, the inner portion 12 of the housing comprises a cylindrical pulverizing chamber 14 wherein shaft 6 horizontally passes therethrough 13 aligned with the central longitudinal axis of the cylinder formed by the inner chamber walls. An array of rotors 15, 15' is fixedly mounted to the shaft 6, in the preferred embodiment, three sets (first set: A, A', second set B, B', third set C, C') of six aligned rotors, the three sets staggered, and each rotor end situated at a sixty degree angle of separation 28 relative to each other set, forming an a high speed, rotating 29 array of rotors having overlapping clearance 17' between pulverizing members, or little clearance pulverizing area facilitated by pulverizing members 52, 16, 16' and the leading edges of the rotors and rotor tips 16 which engage and pulverize debris upon contact, as well as grinding same in the clearance 17 (3/16" to ¼" in the exemplary embodiment) between rotor tips 16 and the inner walls of the screen 18 and other upper wall of the pulverizing chamber 14. Screen 18, forming the cylindrical pulverizing wall for the lower housing 11 includes screen passages or apertures formed therein for passage of processed debris therethrough, which passages, in the preferred embodiment, vary from ⅛" to 1", but generally run about ½" for drill cuttings remediation.

Continuing with the drawings, screen 18 has first 19 and second 19' upper edges which communicate with the upper inside edge 20 of lower housing 11. The base of the upper portion 10 of the housing may have a slight shelf, which one may apply an overcoat O, O' of carbide or the like (for example, DURACOAT 600 brand overcoat) to "fill in" the shelf to prevent the accumulation of debris thereupon. Such an overcoat may also be applied to the top edge of the screen, if it forms a surface where debris may gather.

Instead of a traditional stuffing box to seal the shaft passageway 33 formed in the housing, the present invention utilizes a unique cartridge seal 22, 22' configured to engage the housing at shaft passageway, forming a fluid tight seal, with pillow block bearings 21, 21' supporting the shaft 6 exterior to the housing 4. A coupling 32 may be provided at the end of the shaft for connection to the motor, or connection to a drive shaft.

Figure 3C:
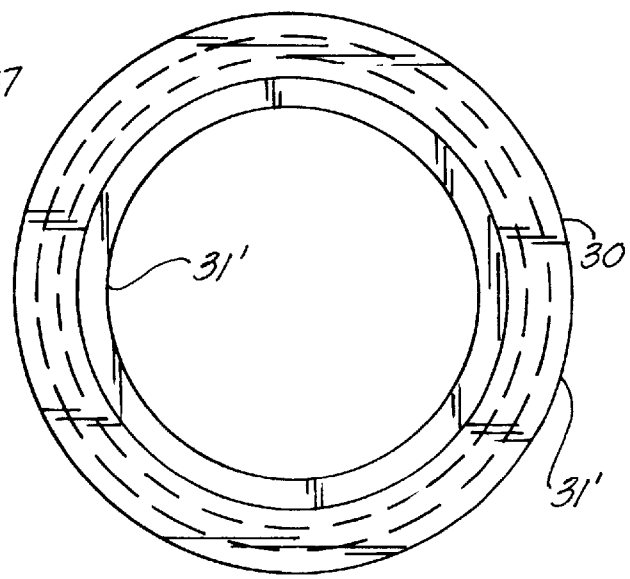
FIG. 3C is an isometric view of the exemplary seal cartridge of FIG. 3A.
Figure 3B:
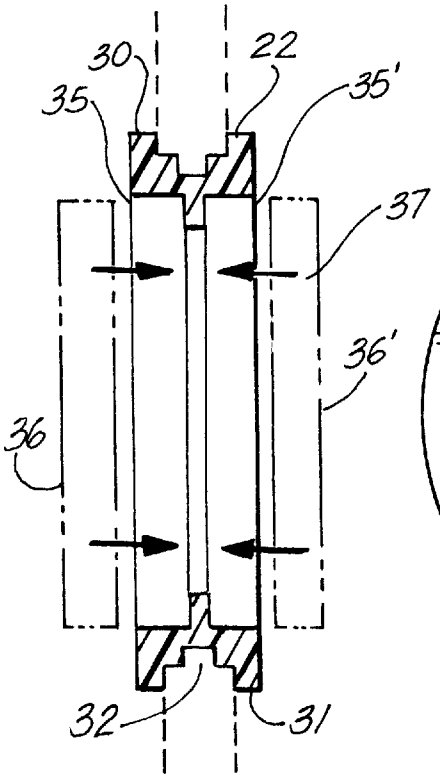
FIG. 3B is an end, partially cut-away view of the seal cartridge of the invention of FIG. 3A.
Figure 3A:
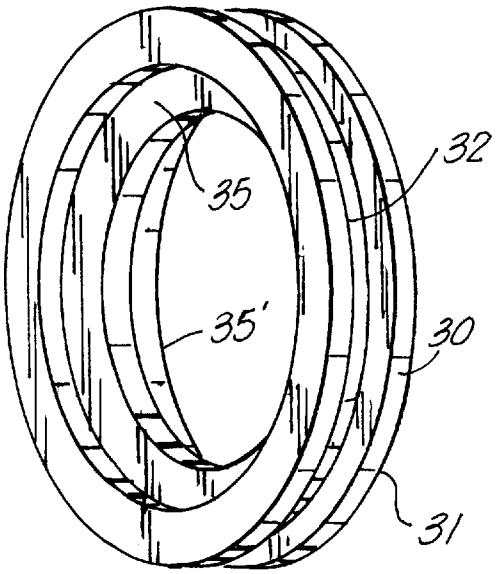
FIG. 3A is a side view of an exemplary seal cartridge utilized to seal the bearings of the present invention.

Continuing with FIGS. 3A, 3B and 3C, the cartridge seal 22 includes a cartridge seal housing 30 having a generally ring configuration having outer, peripheral 31 and inner circular 31' edges, the peripheral edge 31 having formed therein a groove 32 of uniform depth about the circumference of the outer periphery, which groove is configured to interface with the radial shaft cut 33 formed in the side 34 wall of the housing, in such a manner as to provide a sealed passage of the shaft through the inner circular area formed by edge 31', the shaft seal enhanced by first 36 and second 36' seals deposited into slots 35, 35', respectively. The seals in the preferred embodiment of the invention are Federal Mogul brand seal part number 472492.

Figure 4:
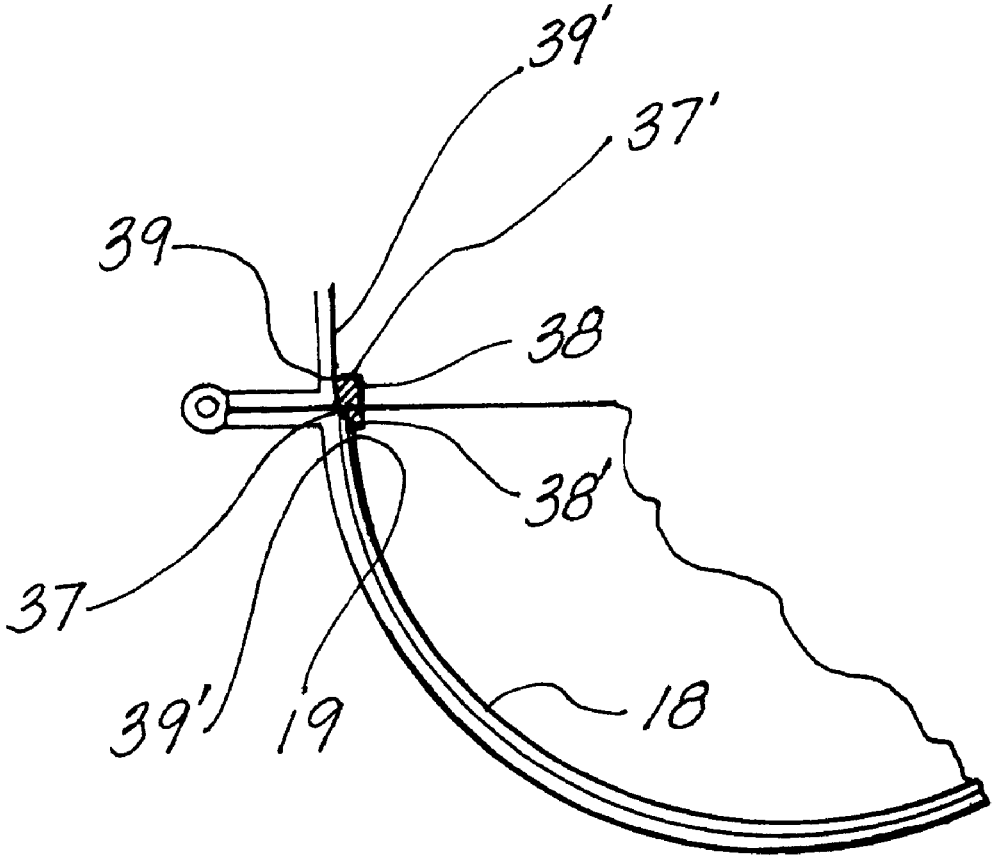
FIG. 4 is a side, partially cut-away view of the screen installation within the housing, particularly with regard to a lug installed to the upper section of the housing configured to engage and cover the upper edge of the screen.

Turning to FIG. 4, the top edges 19 of screen 18 may be secured at each of first, second, third, and forth corners 37 by a lug 38 which is welded 39 to the inside wall 39' of the upper housing, the lug including a lower lip 38' configured to engage 39' the top edge 19 and upper section of screen to prevent rolling back of the screen during operation of the unit.

Figure 1A:
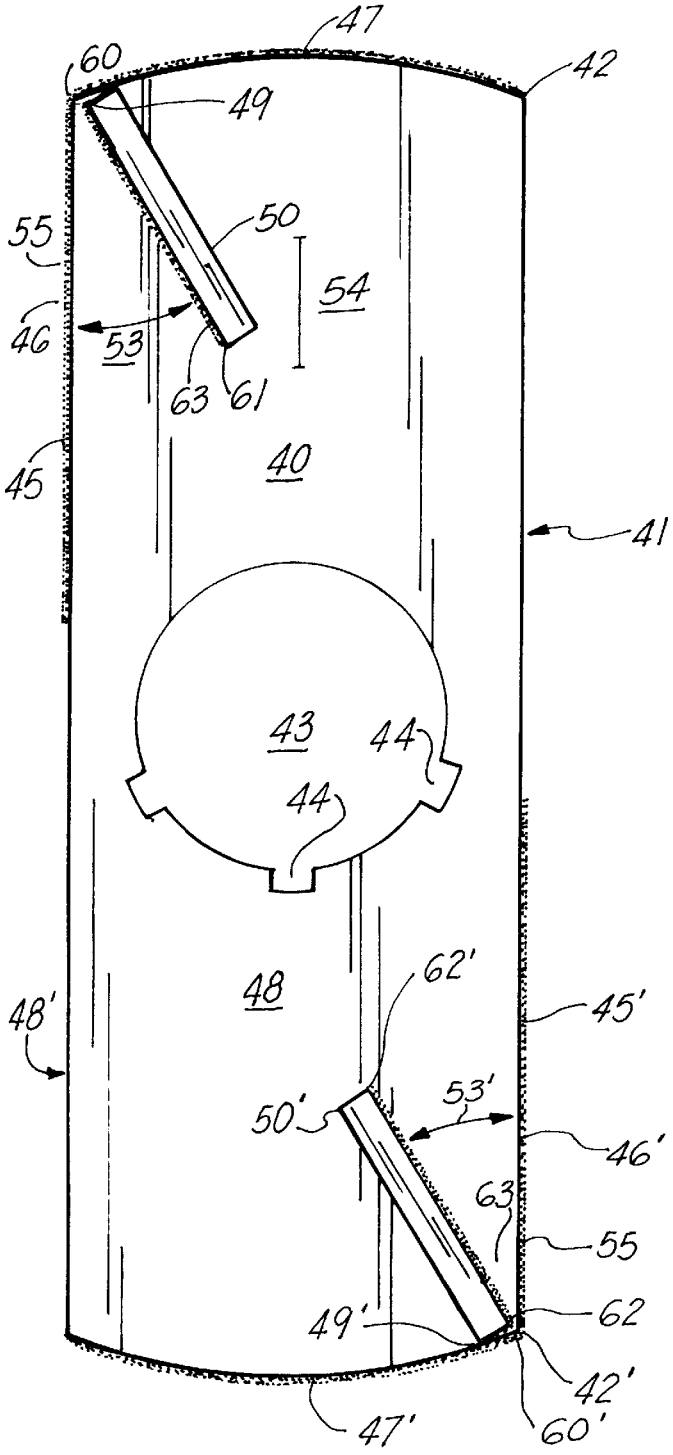
FIG. 1A is a side view of the preferred embodiment of the rotor used in conjunction with the invention of FIG. 1, illustrating the overall configuration, carbide overlay leading edge and top, and pulverizing side members.
Figure 1B:
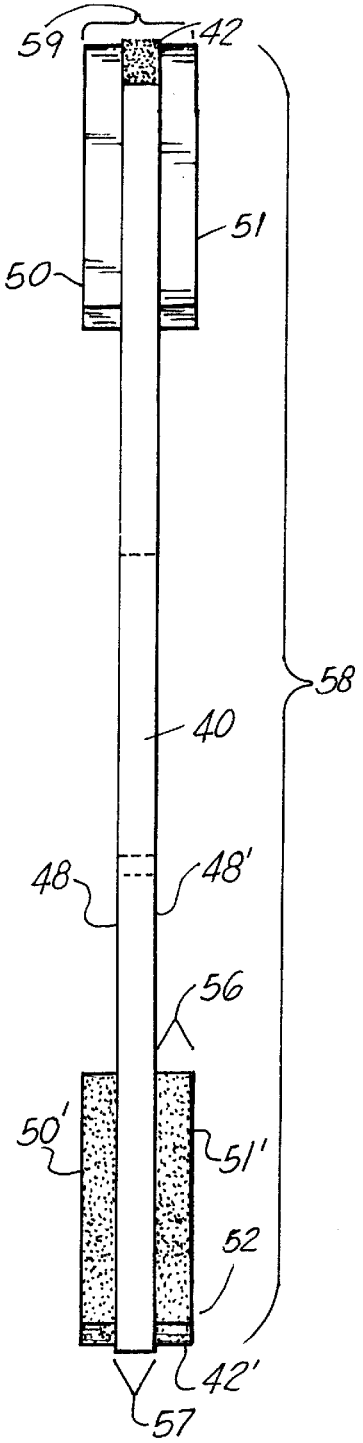
FIG. 1B is an end view of the rotor of FIG. 1A, illustrating the placement of the pulverizing side members on opposing sides of each rotor.

Referring to FIGS. 1A and 1B, each rotor blade 40 of the preferred embodiment of the present invention comprises a generally elongated, rectilinear configuration 41 having first 42 and second 42' ends with a medially situated central shaft passage 43 therebetween. The shaft passage in the exemplary embodiment of the invention is 2⅓ inches and is keyed 44. The blade of the unit shown rotates in a counterclockwise direction, with the leading edges 46, 46' having a carbide overcoat 45, 45' which may be, for example, Durocoat 800 brand overcoat or the like, the overcoat also applied 47, 47' to the ends 42, 42' which functions as a grinding surface in conjunction with the side walls of the cylindrical pulverizing chamber (as indicated, the clearance in the preferred embodiment is about 3/16" to ¼", for example), the leading edges 46, 46' of the rotor functioning as a pulverizing surface.

As shown, the rotor blade 40 further has first 48 and second 48' side walls, and first 60 and second 60' leading corners. Situated at about a thirty degree angle 53, 53' relative to the leading edge are first 50, second 50', third 51, and fourth 51' pulverizing members, emanating from opposing 52 sides of the rotor, each pulverizer/grinder member having first 62 and second 62' ends which may be coated with carbide overcoat, the first end situated adjacent to the leading corners 60, 60', each pulverizing member further having a leading face 55, 55' which is ideally overcoated 63, 36' with carbide overcoat or the like. The opposing pulverizing members 50, 51 and 50', 51' are in mirroring positions on opposing sides of the rotor, so that the opposing pulverizing members 50, 51 and 50', 51' sandwich the rotor 40. The positioning range of the pulverizing members may be 15–45 degrees relative to the leading edge, the optimal positioning angle varying, and other angles may be required under some conditions. In addition, the first ends of the pulverizing members, along with the tips of the rotor, being overcoated with carbide and aligned with one another, function in concert to grind material juxtaposed between the inner walls of the pulverization chamber and the tips of the rotor and pulverizing members.

As shown, each pulverizer/grinder member may be, for example, about ⅜" thick 56 (also, ⅜" wide and 3–5 inches long), which, in combination with the thickness of the rotor (for example, ¼" thick) 57, and the pulverizer/grinder member upon the other side of the rotor mirroring the position of the opposing pulverizer/grinder member (also ⅜"), the total thickness of both pulverizing members sandwiched about rotor in the preferred embodiment is 1", 59, although the thickness may vary somewhat, depending upon the equipment, operating criteria, and environmental criteria. The rotor has a longitudinal axis 54 in general parallel to the leading edge 55 of the rotor, and may be, for example, 18 inches long 58. All of the above measurements are for exemplary purposes only, and may vary depending upon the size of the unit, application, and other criteria. The rotor tips, sandwiched between opposing pulverizing members, functions not only to provide a "wall" of leading edges to engage the material entering the pulverizing chamber, it also acts as a cleaning mechanism for self-cleaning, wherein the leading edges and tips of the pulverizing members and the rotors acts to "wipe" the inner walls of the pulverizing chamber.

Figure 6:
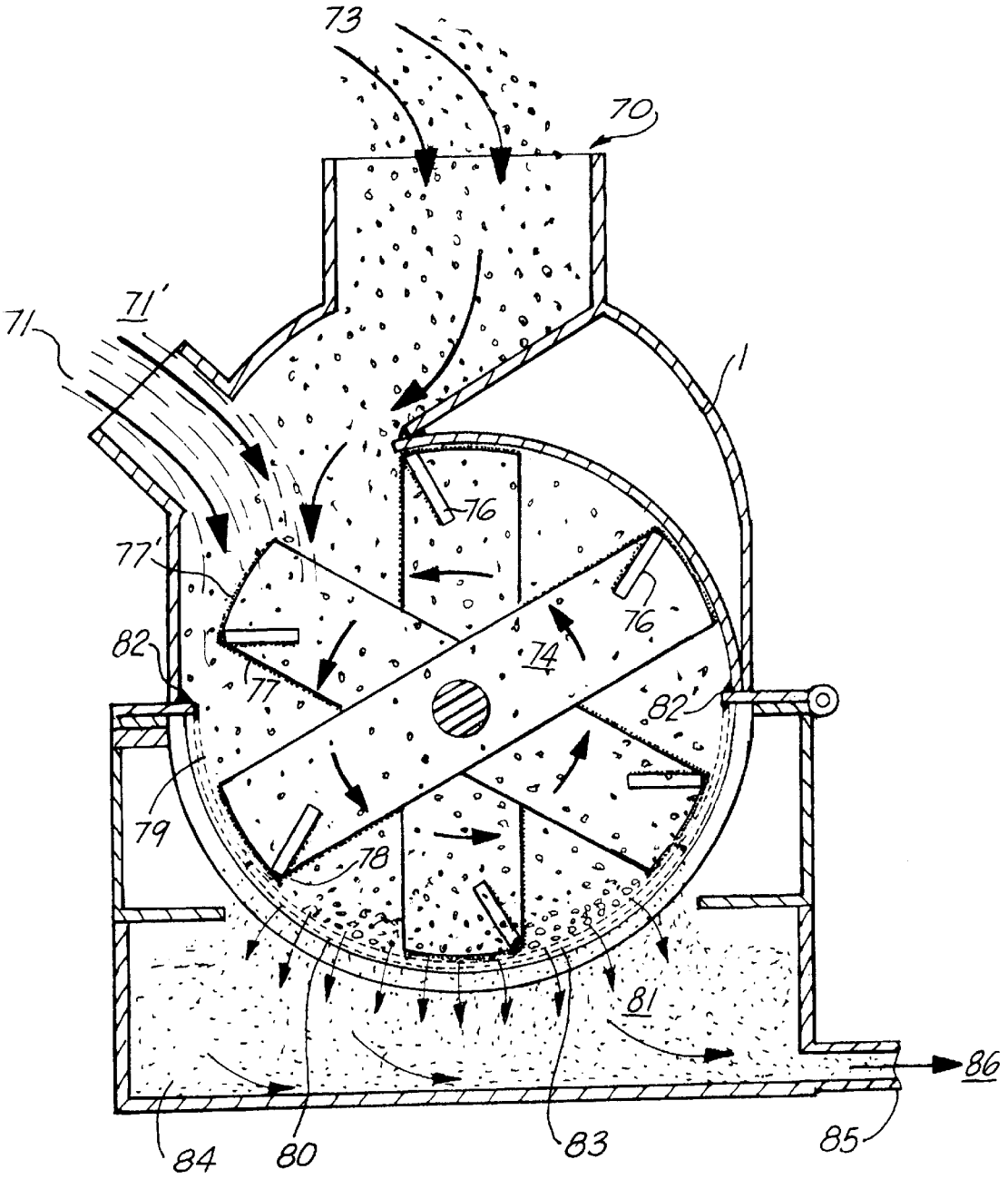
FIG. 6 is an end, partially cut-away view of the pulverizer/grinder of the present system, illustrating the cutting action and flow of debris and fluid through the system in operation.

Continuing with FIG. 6, in operation, the pulverizer/grinder 1 receives cuttings, aggregate, debris or other matter 73 via ingress port 70, which is directed into the pulverizing chamber, where the matter is struck by the rotating 74 array 75 of rotors, the pulverizing member 76, 76' and leading edges 77 of the rotors striking the material at high speed, breaking apart same, the tips 77' of the rotors and pulverizing members grinding the material as it passes in the clearance 78 between the tops of the rotors and pulverizing members, and the screen 80 and the cylindrical walls 79 of the pulverizing chamber, the ground material 81 passing through the screen apertures 83 into the collection tank 84. The ledge 82, 82' formed at the bottom of the upper section of the housing, top of the screen may be filled with an overcoat of carbide to prevent the collection of debris, or excess wear. A processed fluid/particulate line 85 directs the flow 86 of fluid to a recirculation port 71 which may receive the fluid and particulate matter 71', along with, or instead of another fluid, such as seawater, to facilitate better flow of the system, although extra fluid is not always required, and sometimes the unit may even work better dry. Also, it is noted that port 71 may also be used to receive cuttings, aggregate, or other material for processing, depending upon the application, and is not solely relegated to receive fluid material.

Figure 7:
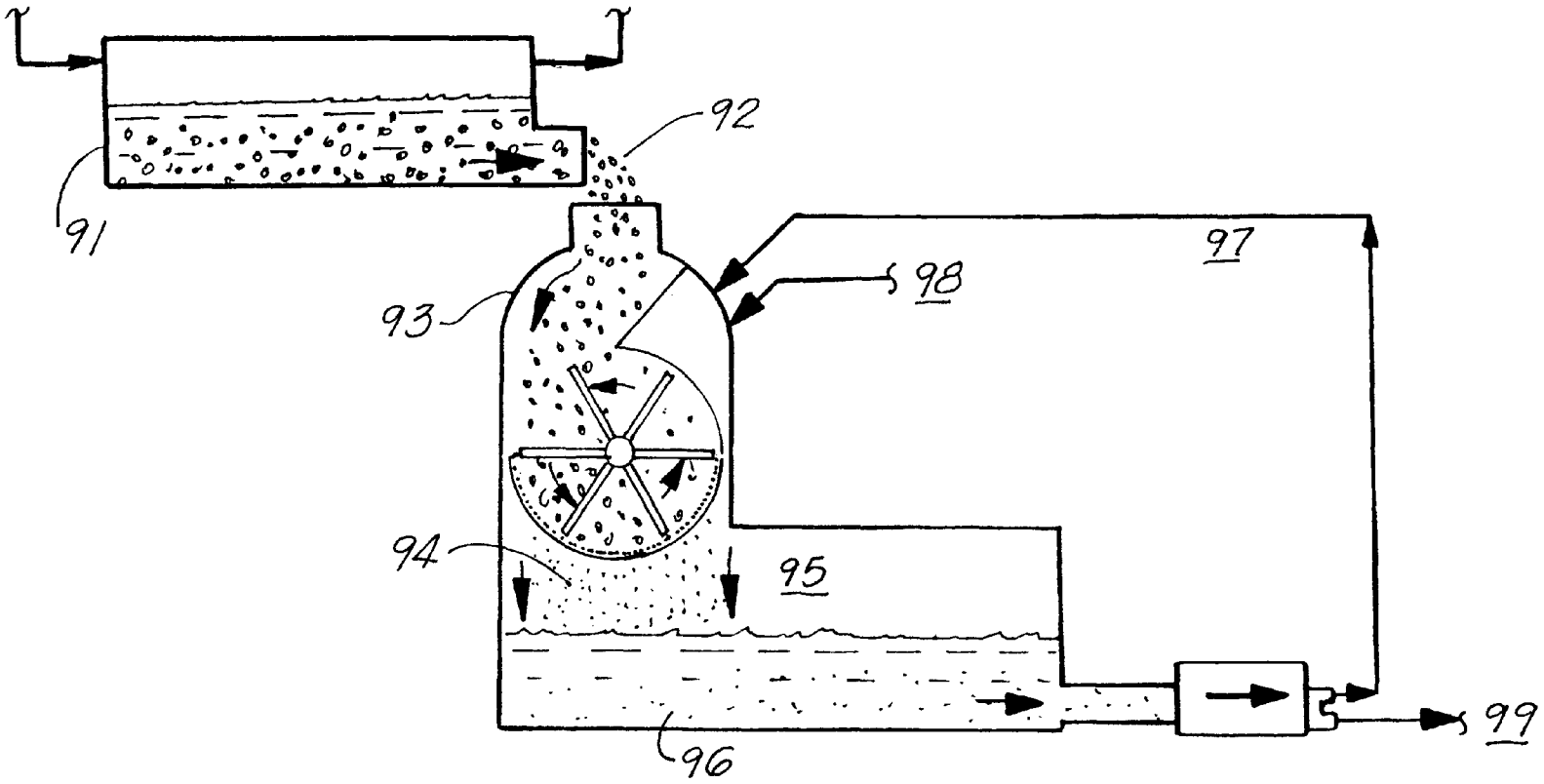
FIG. 7 is an exemplary flow chart of the invention of FIG. 1, illustrating the pulverizer/grinder utilized in conjunction with a drill cutting remediation process.

Lastly, referring to FIG. 7, an exemplary operation of the system when utilized in conjunction with drilling cuttings remediation may comprise the steps of providing the pulverizer/grinder 93 atop slurry tank 96, and mounting a shaker 91 or stratification tank receiving material from a shaker to flow to ingress port 92 on pulverizer/grinder, where the material enters the pulverizing chamber to be pulverized and ground by rotors 94 and pulverizing members, upon being reduced to the appropriate size the material passes through the screen 95 and into the slurry tank 96, where a portion of it may be recirculated 97 back to the grinder as is required, in addition to or with fluid from a water source 99, the rest of the slurry being introduced, or injected, back into the well 99.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A rotor blade for a pulverizer/grinder system comprising:

a generally rectilinear body having first and second ends and a medial area therebetween, and first and second sides;

a shaft aperture formed in said medial area of said body;

said body further comprising having first and second leading corners opposing one another, said body further comprising first and second leading edges adjacent to said first and second leading corners, respectively;

first and second pulverizing members having first and second ends, a length, a width, and a leading face, said first pulverizing member mounted to said first side of said body, said second pulverizing member mounted to said second side of said body, said first ends of said first and second pulverizing member mounted adjacent to said first leading corner, respectively, each of said first and second pulverizing members situated at an angle of between fifteen and forty-five degrees relative to said first leading edge.

2. The rotor blade of claim 1, wherein there is further provided third and fourth pulverizing members having first and second ends, a length, a width, and a leading face, said third pulverizing member mounted to said first side of said body, said fourth pulverizing member mounted to said second side of said body, said first ends of said first and second pulverizing member mounted adjacent to said second leading corner, respectively, each of said first and second pulverizing members situated at an angle of between fifteen and forty-five degrees relative to said second leading edge.

3. The rotor blade of claim 2, wherein said first and second ends, said leading corners, and said first and second leading edges, and said first end and leading face of said pulverizing members are coated with an overcoat of hardening material.

4. The rotor blade of claim 3, wherein said hardening material is carbide.

5. The rotor blade of claim 4, wherein said first and second pulverizing members are mounted at an angle of between twenty-five and thirty degrees relative to said first leading edge.

6. The rotor blade of claim 5, wherein said second and third pulverizing members are mounted at an angle of between twenty-five and thirty degrees relative to said second leading edge.

7. A pulverizer/grinder, comprising:

a housing having an ingress port, and a grinding/pulverization chamber, said grinding/pulverization chamber having a sidewall, at least part of said sidewall formed by a screen having apertures formed therein;

a plurality of rotors situated in said chamber, each of said rotors comprising:

a generally rectilinear body having first and second ends and a medial area therebetween, and first and second sides;

a shaft aperture formed in said medial area of said body;

said body further comprising having first and second leading corners opposing one another, said body further comprising first and second leading edges adjacent to said first and second leading corners, respectively;

first and second pulverizing members having first and second ends, a length, a width, and a leading face, said first pulverizing member mounted to said first side of said body, said second pulverizing member mounted to said second side of said body, said first ends of said first and second pulverizing member mounted adjacent to said first leading corner, respectively, each of said first and second pulverizing members situated at an angle of between fifteen and forty-five degrees relative to said first leading edge;

said first end of said pulverizing member, and said first and second ends of said rotor configured to engage material against said sidewall of said grinding/pulverization chamber to grind said material, said leading faces of said first and second pulverizing members, and said first and second leading edge of said body configured to strike and pulverize said material as said rotors rotate about said shaft.

8. The rotor blade of claim 7, wherein there is further provided third and fourth pulverizing members having first and second ends, a length, a width, and a leading face, said third pulverizing member mounted to said first side of said body, said fourth pulverizing member mounted to said second side of said body, said first ends of said first and second pulverizing member mounted adjacent to said second leading corner, respectively, each of said first and second pulverizing members situated at an angle of between fifteen and forty-five degrees relative to said second leading edge.

9. The rotor blade of claim 8, wherein said first and second ends, said leading corners, and said first and second leading edges, and said first end and leading face of said pulverizing members are coated with an overcoat of hardening material.

10. The rotor blade of claim 9, wherein said hardening material is carbide.

11. The rotor blade of claim 10, wherein said first and second pulverizing members are mounted at an angle of between twenty-five and thirty degrees relative to said first leading edge.

12. The rotor blade of claim 11, wherein said second and third pulverizing members are mounted at an angle of between twenty-five and thirty degrees relative to said second leading edge.

13. The method of grinding and pulverizing a material comprising the steps of:

a. providing a pulverizer/grinder, comprising:

a housing having an ingress port, and a grinding/pulverization chamber, said grinding/pulverization chamber having a sidewall, at least part of said sidewall formed by a screen having apertures formed therein;

a plurality of rotors situated in said chamber, each of said rotors comprising:

a generally rectilinear body having first and second ends and a medial area therebetween, and first and second sides;

a shaft aperture formed in said medial area of said body;

said body further comprising having first and second leading corners opposing one another, said body further comprising first and second leading edges adjacent to said first and second leading corners, respectively;

first and second pulverizing members having first and second ends, a length, a width, and a leading face, said first pulverizing member mounted to said first side of said body, said second pulverizing member mounted to said second side of said body, said first ends of said first and second pulverizing member mounted adjacent to said first leading corner, respectively, each of said first and second pulverizing members situated at an angle of between fifteen and forty-five degrees relative to said first leading edge;

said first end of said pulverizing member, and said first and second ends of said rotor configured to engage material against said sidewall of said grinding/pulverization chamber to grind said material, said leading faces of said first and second pulverizing members, and said first and second leading edge of said body configured to strike and pulverize said material as said rotors rotate about said shaft;

b. providing a flow of material from into said ingress port of said pulverizer/grinder;

c. directing said flow of said material from said ingress port to said grinder/pulverization chamber;

d. rotating said shaft at between 1000–2250, rotating said rotor array;

e. allowing said leading edges of said rotors, and said leading faces of said pulverizing members to strike said material in order to shatter same;

f. allowing said first and second tips of said rotors, and said first ends of said pulverizing members, to engage said material against said sidewall of said pulverizer/grinder;

g. repeating steps d–f until the material is reduced to a particulate size which may pass through the apertures formed in said screen.

* * * * *